United States Patent [19]

Stuart

[11] 3,937,173

[45] Feb. 10, 1976

[54] DEEP-V TUNNEL STERN BOAT

[75] Inventor: Robert B. Stuart, Penn Yan, N.Y.

[73] Assignee: Penn Yan Boats, Incorporated, Penn Yan, N.Y.

[22] Filed: Sept. 11, 1974

[21] Appl. No.: 504,874

Related U.S. Application Data

[63] Continuation-in-part of Ser. No. 408,675, Oct. 23, 1973, abandoned.

[52] U.S. Cl. ..... 115/39

[51] Int. Cl.[2] ..... B63H 5/16

[58] Field of Search ..... 115/39, .5 R, 12 R, 14, 115/16, 34 R; 114/57, 62

[56] References Cited

UNITED STATES PATENTS

| | | | |
|---|---|---|---|
| 23,105 | 3/1859 | Montgomery | 114/62 |
| 3,469,557 | 9/1969 | Wollard | 115/39 |
| 3,515,087 | 6/1970 | Stuart | 115/39 |
| 3,742,895 | 7/1973 | Horiuchi | 115/34 R |
| 3,744,446 | 7/1973 | Gibbins | 115/39 |
| 3,811,399 | 5/1974 | Kobayashi et al. | 115/39 |

*Primary Examiner*—Trygve M. Blix
*Assistant Examiner*—Charles E. Frankfort
*Attorney, Agent, or Firm*—Stonebraker, Shepard & Stephens

[57] ABSTRACT

A deep-V tunnel stern boat has the forward portion of the tunnel shaped for uniformly distributing the resurgent flow across the width of the tunnel and for smoothly forming the entrance curve to the tunnel to optimize a suction tending to lift the water into the tunnel. This is done by recessing port and starboard halves of the tunnel into the sides of the hull bottom so the tops of the tunnel halves are approximately parallel with the sides of the hull bottom at the deep-V angle and meet at an obtuse angle above the keel line. The tops of the tunnel halves are gradually shaped into a semi-cylinder around the upper half of the propeller, the tunnel sides are flared outward aft of the propeller, and exhaust ports are located in the flared tunnel sides. Such tunnels are also adapted for twin tunnel stern boats.

11 Claims, 21 Drawing Figures

DEEP-V TUNNEL STERN BOAT

RELATED APPLICATIONS

This application is a continuation-in-part of my copending parent application, Ser. No. 408,675, filed Oct. 23, 1973, entitled DEEP-V TUNNEL STERN BOAT, and abandoned upon the filing of this application.

THE INVENTIVE IMPROVEMENT

The invention springs from several years' experience in deep-V tunnel stern planing boats including various tunnel shapes and flares, propeller positioning in tunnels, and tunnel exhaust systems, and this experience has shown that slight variation in some of the parameters can have surprising effects. The invention seeks to improve on the performance and reduce the noise of prior art deep-V tunnel stern boats, and the invention involves recognition of a better tunnel shape for uniformly distributing the resurgent flow and surface tension lift across the width of the tunnel, a better exhaust system, and optimum positioning of the propeller in a flared tunnel.

SUMMARY OF THE INVENTION

The invention applies to a boat having port and starboard sides of the hull bottom inclined upward from the keel line in a deep-V angle and having a propeller substantially housed in a stern tunnel. The port and starboard halves of the forward region of the tunnel are recessed respectively into the sides of the hull bottom to a depth progressively increasing with distance aft from the forward end of the tunnel. The tops of each of the halves of the forward region of the tunnel are generally flat and approximately parallel with the sides of the hull bottom at the deep-V angle and meet at an obtuse angle above the keel line. The halves of the tunnel have a constant width of slightly more than the radius of the propeller, and the tops of the tunnel halves are gradually shaped into a semi-cylinder around the upper half of the propeller. The invention also includes an aft-of-propeller region terminating in a plane perpendicular to the rotational axis of the propeller with the tunnel opening radially outward around substantially the entire perimeter of the tunnel at the after edge of the aft-of-propeller region.

DRAWINGS

DETAILED DESCRIPTION

Figure 1:
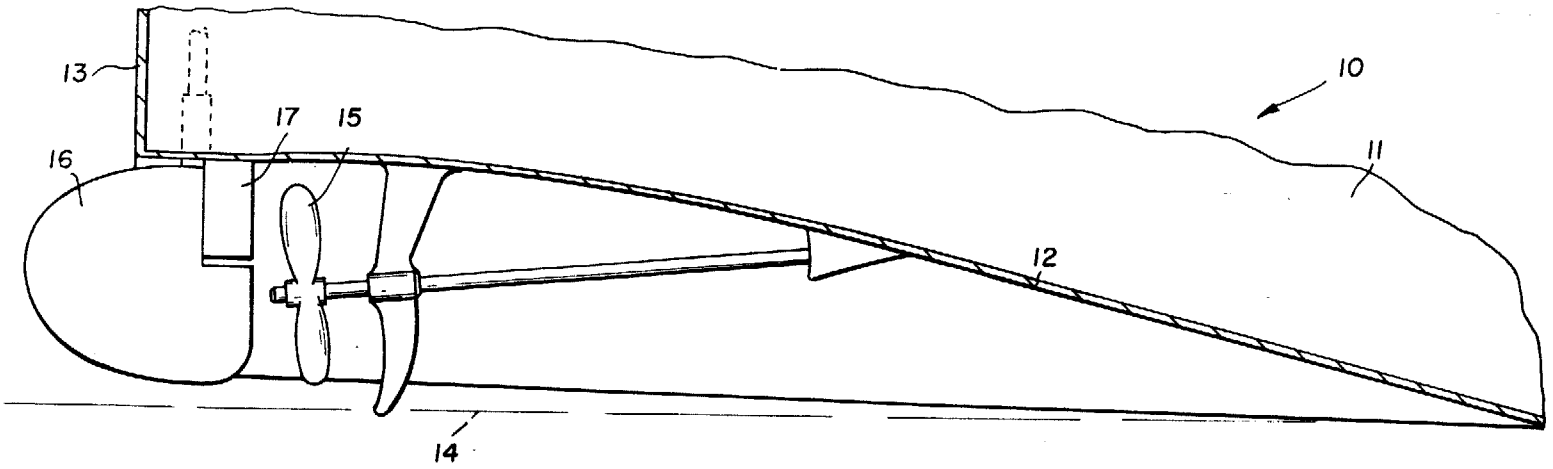
FIG. 1 is a longitudinal cross-sectional view of a preferred embodiment of the inventive deep-V tunnel stern boat.

As shown in FIG. 1, boat 10 has a deep-V hull 11 having a stern tunnel 12 gradually enlarging above keel line 14 as it extends aft to transom 13. A propeller 15 is turned in tunnel 12, and a movable rudder 16 and a fixed vane 17 are arranged aft of propeller 15 for steering boat 10. In the region of propeller 15 the top of tunnel 12 is semi-cylindrical and fits fairly closely over the top of propeller 15. The invention involves a more efficient shape for tunnel 12, a better exhaust system for boat 10, and the correct positioning of propeller 15 in tunnel 12, as described below.

Figure 3:
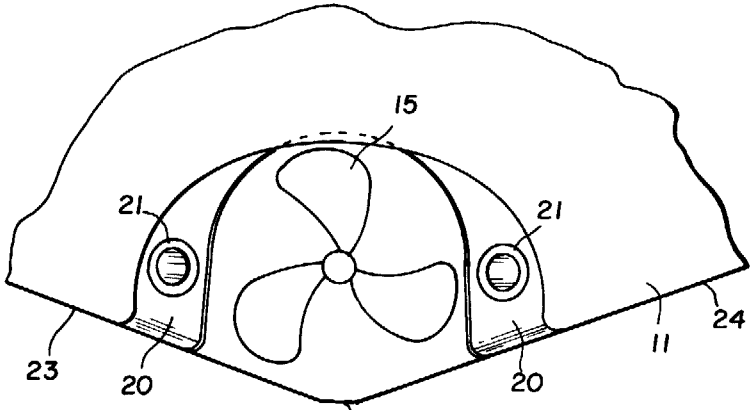
FIG. 3 is a fragmentary, rear-elevational view of the tunnel of the boat of FIG. 1 with the rudder removed.
Figure 2:
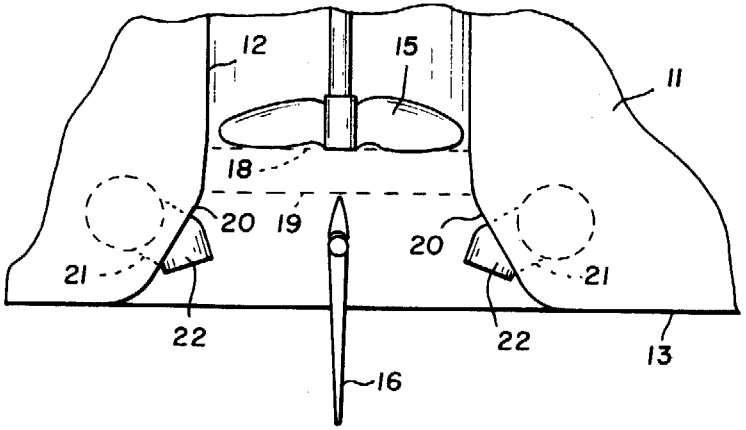
FIG. 2 is a fragmentary, bottom view of the stern end of the tunnel of the boat of FIG. 1.

As best shown in FIGS. 2 and 3, tunnel 12 fits fairly closely around propeller 15 with a clearance of an inch or less and extends aft of propeller 15 a short distance and then flares horizontally outwardly. The aft-of-propeller region of tunnel 12 has a shape fitting around propeller 15 and extending aft of the trailing edge of the blades of propeller 15 as indicated by broken line 18 for 25% to 40% of the radius of propeller 15 to broken line 19. The aft-of-propeller region of tunnel 12 enlarges slightly in cross-sectional area as it extends aft from line 18 to line 19, but any outward taper of tunnel 12 between lines 18 and 19 is preferably very slight and does not exceed 5° to 7°. A larger taper would permit rearward ventilation reducing efficiency and causing noise and vibration from cavitation. The space extending for 25% to 40% of the propeller radius in the aft-of-propeller region of tunnel 12 between lines 18 and 19 holds the water in tunnel 12 sufficiently to prevent propeller 15 from cavitating, but does not extend so far as to increase the turbulence and drag. The stream of water thrust aft by propeller 15 tends to expand slightly as it proceeds aft, and the distance between lines 18 and 19 in the aft-of-propeller region of the tunnel is short enough so as not to interfere with the natural expansion of the water stream from propeller 15. Extending the aft-of-propeller region of the tunnel aft by more than 40% of the propeller radius causes turbulence, noise, and drag, and shortening the aft-of-propeller region to less than 25% of the propeller radius causes cavitation, efficiency loss, and noise.

Tunnel 12 has a discharge region aft of line 19 and the aft-of-propeller region, and the discharge region extends to transom 13 at the after end of tunnel 12 where tunnel 12 opens out at the stern of boat 10. In the discharge region the side walls 20 of tunnel 12 flare sharply outward horizontally at preferably 30° or more from the keel line 14 to allow plenty of room for the ballooning or expanding water stream from propeller 15 and clearance for operation of rudder 16. Also, exhaust ports 21 direct engine exhaust for boat 10 through walls 20 into the water stream from propeller 15, and exhaust ports 21 can either be plain openings as shown in FIG. 3 or covered with streamlined cowlings 22 as shown in FIG. 2. Directing the exhaust into the water stream emerging from tunnel 12 provides an underwater exhaust without causing back pressure on the engine of boat 10, because the exhaust is directed into a high-speed stream of water. This contributes to quiet operation and a simple and trouble-free exhaust system.

Figure 4:
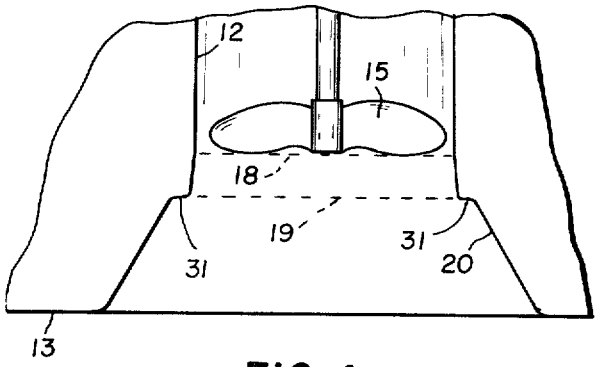
FIGS. 4 and 5 are fragmentary, bottom views of the stern end of alternative tunnels for the boat of FIG. 1.
Figure 5:
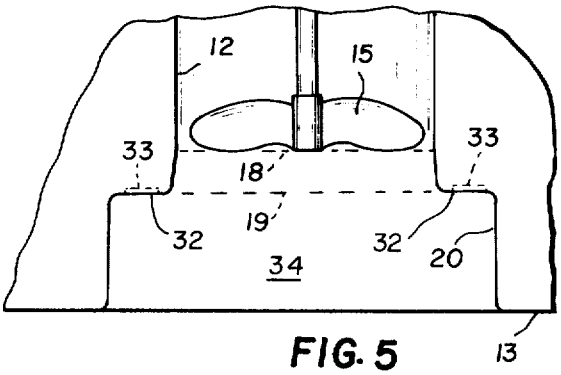
Figure 6:
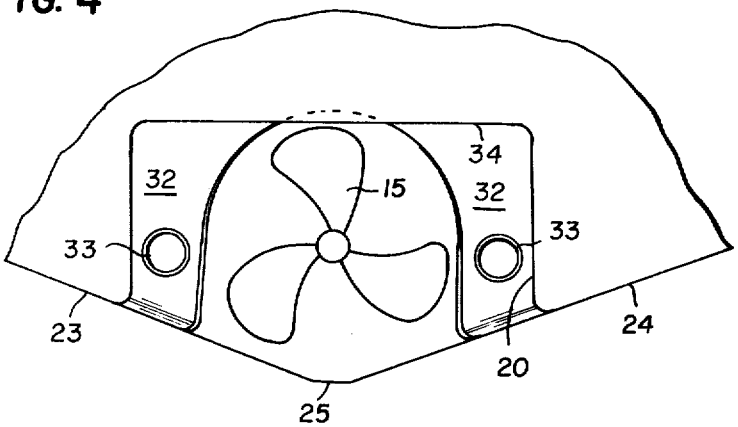
FIG. 6 is a fragmentary, rear-elevational view of the tunnel of FIG. 5 with the rudder removed.

The side walls 20 of the discharge region of tunnel 12 can be formed in different ways as shown in the drawings. In FIG. 4, walls 20 are angled horizontally outward at 30° or more from the keel line, and an annular wall 31 extends laterally outward at the beginning of the discharge region forward of walls 20. This allows a little extra clearance for the ballooning water stream from propeller 15 and can be combined with various shapes of tunnel tops in the discharge region. A laterally extending annular wall 32 in the discharge region of the tunnel 12 illustrated in FIGS. 5 and 6 extends farther outward than annular wall 31 of FIG. 4 so that the sidewalls 20 of the discharge region of FIGS. 5 and 6 can extend straight aft to transom 13. Lateral walls 32 are wide enough to accommodate exhaust ports 33 for exhausting into the water stream thrust aft from propeller 15. The top wall 34 of the discharge region of FIGS. 5 and 6 is horizontal to give the discharge region a generally rectangular shape, and various horizontally extended sidewalls 20 can be combined with flat or rounded tunnel tops in the discharge region.

The improved shape of tunnel 12 is best shown in FIGS. 7–12 where the port side 23 and the starboard side 24 of the bottom of hull 11 are shown inclined upwardly from keel 25 and keel line 14 at a deep-V dead rise angle. For a deep-V planing hull 11, hull bottom sides 23 and 24 incline steeply upward from the keel line 14 as illustrated, and as well known in the art, and such inclination is called the dead rise angle. The forward region of tunnel 12 is divided in half, and the top 26 of the port half is recessed into port side 23 of the hull bottom, and the top 27 of the starboard half is recessed into starboard side 24 of the hull bottom. Tops 26 and 27 are approximately parallel respectively with hull bottom sides 23 and 24 at the dead rise angle and meet at an obtuse angle above keel line 14 as illustrated. As tunnel 12 proceeds aft, top halves 26 and 27 are recessed progressively deeper into hull bottom sides 23 and 24 so that the cross-sectional area of tunnel 12 gradually enlarges. Tunnel tops 26 and 27 curve into sidewalls 28 and 29 that are angled between the vertical and respective perpendiculars to hull bottom sides 23 and 24.

Figure 12:
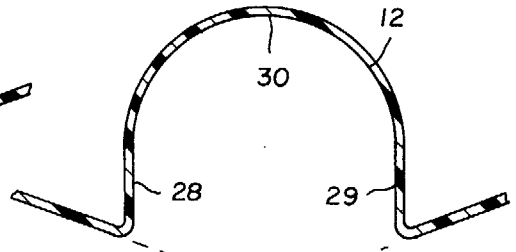
FIGS. 8–12 are respective cross-sectional views taken along the indicated lines for the tunnel of FIG. 4.
Figure 10:
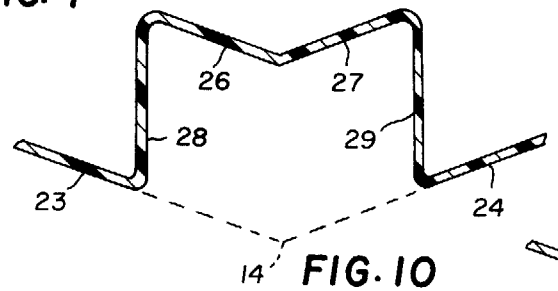
Figure 11:
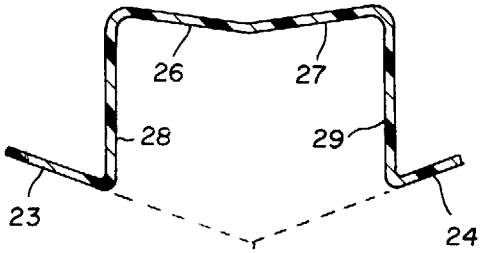
Figure 8:
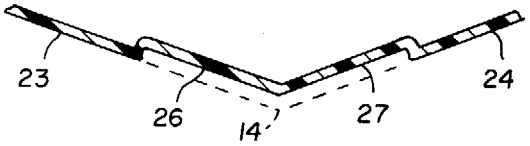
Figure 9:
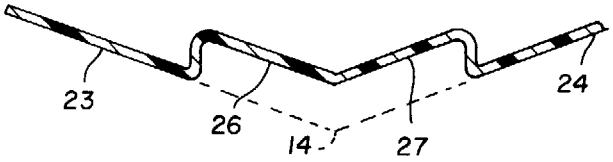

FIG. 12 is a cross section in the plane of the propeller and shows semi-cylindrical tunnel top 30 shaped to fit over the top of the propeller. As tunnel 12 approaches the propeller in the region of the cross section of FIG. 11, tunnel tops 26 and 27 are gradually diverted up in their central regions to meet at progressively larger angles and then to form gradually into semi-cylinder 30.

The shape of tunnel 12 as shown in FIGS. 7–12 provides a significant increase of over 10% in the performance of boat 10 over the best known prior art tunnel. To understand this requires an understanding of resurgent flow. Resurgent flow is the tendency of the water to flow upward into an available space behind the hull as the hull moves through the water. The resurgent flow is a function of gravity, the natural water level relative to the hull, the speed of the hull, and the space available to receive the flow. The best prior art tunnels did not properly consider or allow for full resurgent flow, and the invention involves a realization that the resurgent flow can be uniformly distributed throughout the full width of the tunnel and made gradual and smooth for flowing the optimum amount of water up into the tunnel to feed propeller 15 smoothly with unbroken and relatively non-turbulent water.

Prior art tunnels generally had rounded tops and gradually enlarged in cross section as they proceeded aft toward the propeller. Because of the deep-V hull shape, the forward end of any such tunnel tended to come to a point at the keel line, and the resurgent flow poured up into varying tunnel heights across any given tunnel width. Rounded top tunnels provided a large cavity for resurgent flow at the keel line, and relatively smaller and less elevated cavities toward the sides of the tunnel. At high speeds, the resurgent flow could not rise rapidly enough to fill the tunnel in the more elevated cavity above the keel, and there was not enough room for an ample amount of resurgent flow toward the side edges of the tunnel.

The inventive tunnel shape improves on this in providing a tunnel cavity of uniform elevation across its entire width to receive a full width of resurgent flow uniformly distributed and rising gradually and evenly into the tunnel to the same elevation along any given width. This lets the water fill the tunnel smoothly throughout its full length to achieve a surprising increase in efficiency of over 10%. The inventive tunnel shape retains maximum dynamic lift, minimally detracts from the performance of the hull, and provides for optimum resurgent flow. It also improves on the exhaust system and provides for optimum propeller location in a flared tunnel. Each half of tunnel 12 has a constant width of slightly more than the radius of propeller 15 throughout its full length from its forward end back to propeller 15, and each half of tunnel 12 gradually and uniformly enlarges in cross-sectional area and elevation as it proceeds aft. This gradually enlarges the cross-sectional area of the tunnel and also gradually enlarges the wetted surface area of the tunnel with distance aft from the forward end of the tunnel. The inventive tunnel shape also provides a smooth and uniform longitudinal curve to the tunnel entrance optimizing the suction effect of propeller 15 in lifting the water smoothly and evenly into the tunnel.

The invention can also be applied to twin tunnel boats as shown in FIGS. 13–18. Boat 40 of FIG. 13 has a pair of tunnels 41 and 42 recessed respectively into port hull bottom side 43 and starboard hull bottom side 44 on opposite sides of keel 45 and opening outward at transom 46. Tunnels 41 and 42 are similar to tunnel 12 for a single-tunnel boat, and tunnels 41 and 42 are divided into outboard halves 47 and inboard halves 48 as illustrated. To keep the resurgent flow even, inboard halves 48 extend further forward than outbaord halves 47 and as shown in the cross-section of FIG. 14, inboard halves 48 are deeper relative to the hull bottom sides than outboard halves 47. The greater forward extension of inboard halves 48 compensates for this in giving the water a greater distance to flow upward into inboard halves 48.

The tops of tunnels 41 and 42 are gradually formed into semi-cylinders just forward of propellers 49. Tunnels 41 and 42 each have aft-of-propeller regions 50 extending aft of the trailing edge of the blades of propellers 49 by 25% to 40% of the radius of propellers 49 as described above. Rudders 51 are positioned to extend from aft-of-propeller regions 50 aft through discharge regions 52 having side walls 53 extending horizontally outward in any of the ways previously described. The operation and effect of tunnels 41 and 42 is essentially the same as for tunnel 12 as previously described.

Figure 16:
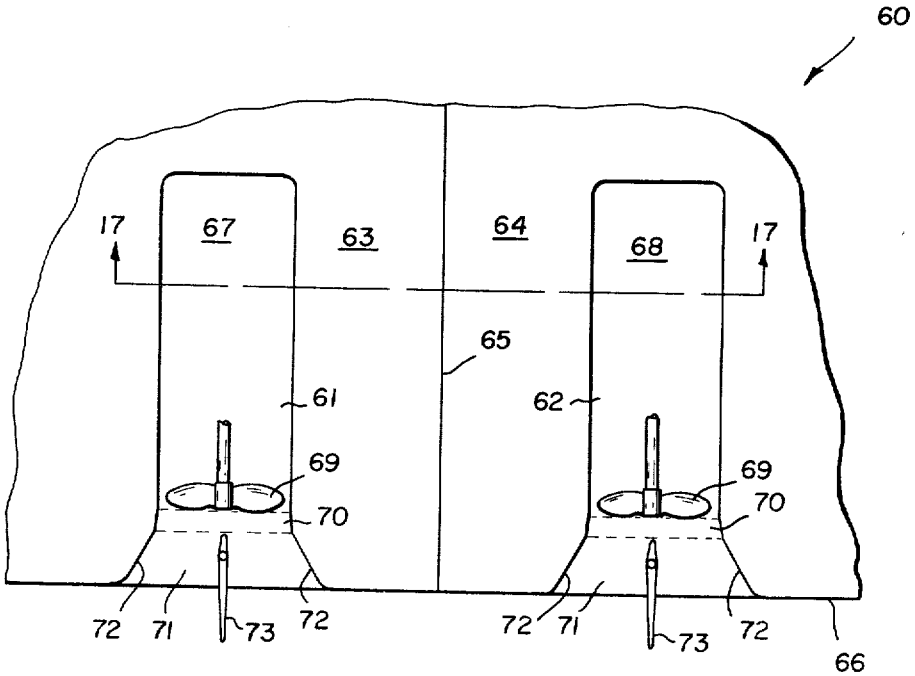
FIG. 16 is a fragmentary bottom view of another twin tunnel version of the invention.
Figure 7:
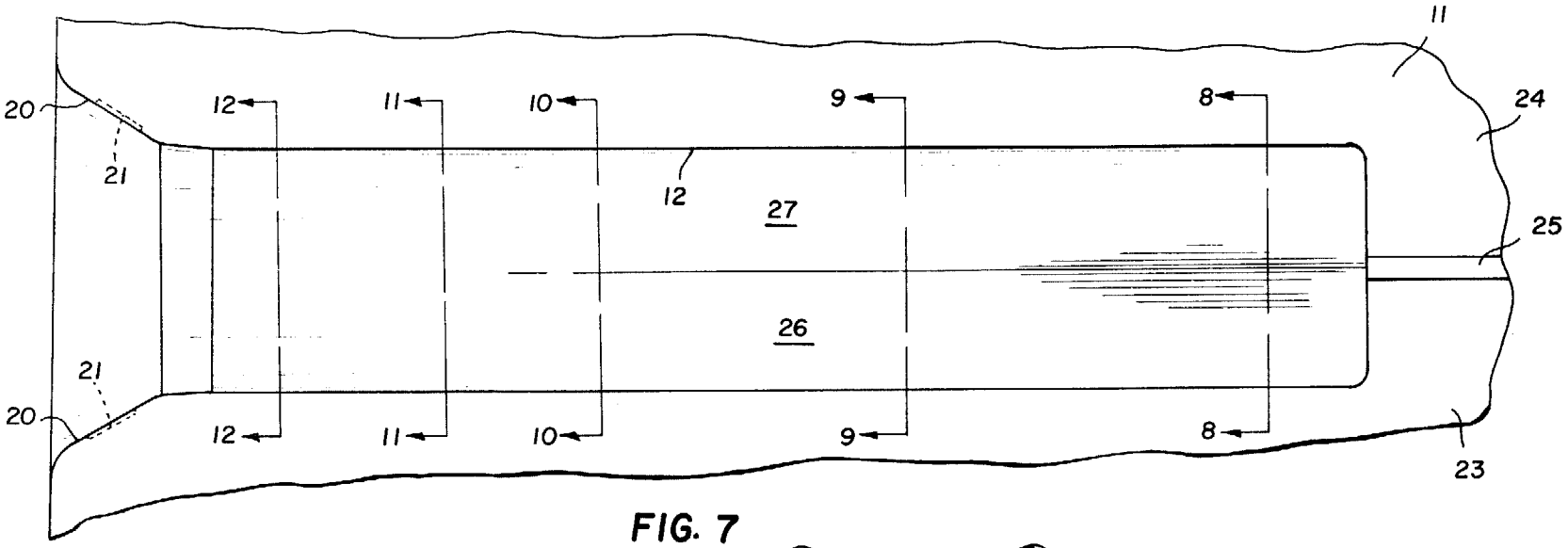
FIG. 7 is a fragmentary, bottom view of the tunnel of the boat of FIG. 1 with equipment removed.
Figure 17:
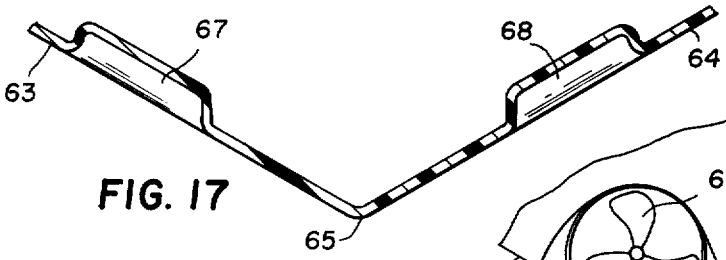
FIG. 17 is a fragmentay cross-sectional view of the boat of FIG. 16 taken along the line 17—17 thereof.
Figure 18:
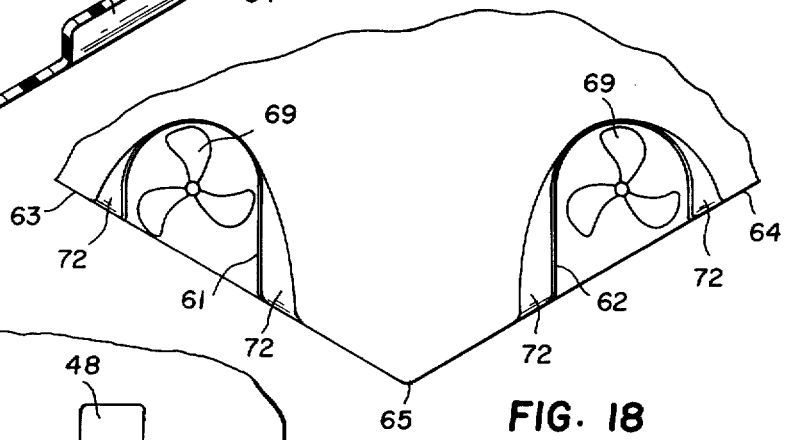
FIG. 18 is a fragmentary stern elevational view of the boat of FIG. 16.
Figure 13:
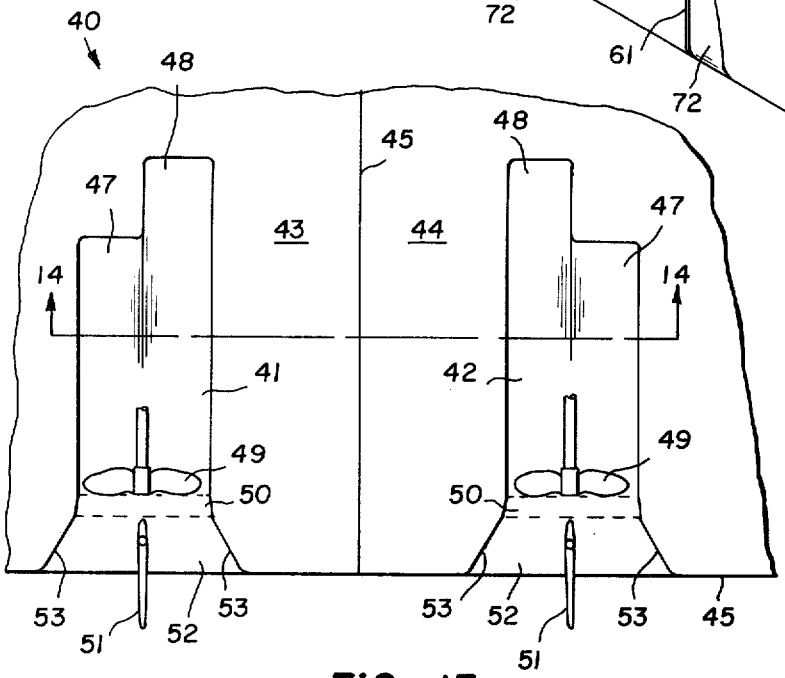
FIG. 13 is a fragmentary bottom view of a twin tunnel version of the invention.
Figure 14:
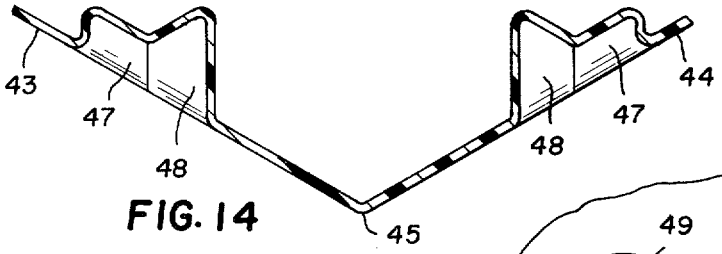
FIG. 14 is a cross-sectional view of the boat of FIG. 13 taken along the line 14—14 thereof.
Figure 15:
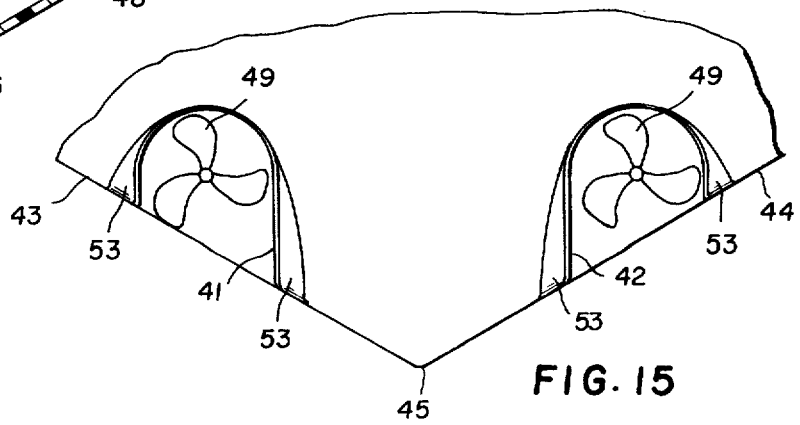
FIG. 15 is a fragmentary stern elevational view of the boat of FIG. 13.

Boat 60 as shown in FIGS. 16–18 has a pair of tunnels 61 and 62 recessed respectively into hull bottom sides 63 and 64 on opposite sides of keel 65 and opening outward at transom 66. The top 67 of tunnel 61 is parallel with hull bottom side 63, and the top 68 of tunnel 62 is parallel with hull bottom side 64 as best shown in the cross-section view of FIG. 17. Tops 67 and 68 are recessed gradually deeper into hull bottom sides 64 and 65 as tunnels 61 and 62 proceed aft. Just forward of propellers 69, tunnel tops 67 and 68 are gradually formed into semi-cylinders, and tunnels 61 and 62 include aft-of-propeller regions 70 and discharge regions 71 having horizontally extending side walls 72 of any of the above-described designs. Rudders 73 extend aft from aft-of-propeller regions 70 between the horizontally extending side walls 72 of discharge regions 71. Tunnels 61 and 62 have uniform resurgent flow across their full widths for their full lengths and their operation and effect is essentially the same as that described above for tunnel 12.

Experience with the invention since the parent application was filed has resulted in even further improvement of the inventive tunnel. The portion of the tunnel forward of the propeller remains as previously described with the total tunnel width being constant and slightly more than the propeller diameter, and the tunnel enlarging in cross-sectional area and in wetted surface area with distance aft from the forward end of the tunnel. The improvement occurs in the region of the tunnel aft of the propeller and is best illustrated in FIGS. 19–21.

Figure 19:
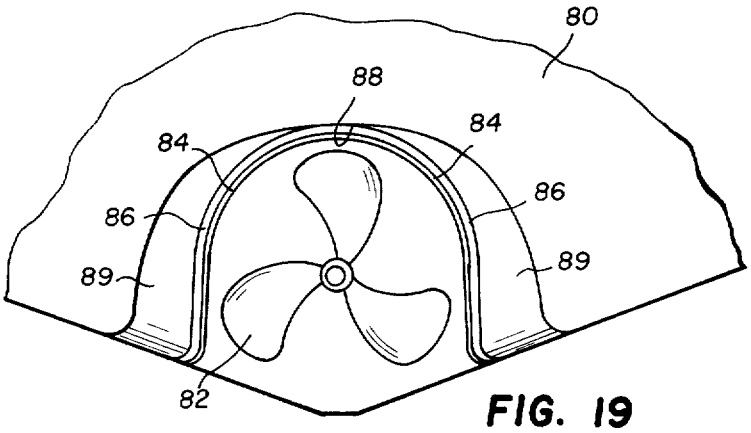
FIG. 19 is a fragmentary rear elevational view of another preferred embodiment of the inventive tunnel stern boat with the rudder removed to better illustrate a preferred tunnel shape.
Figure 20:
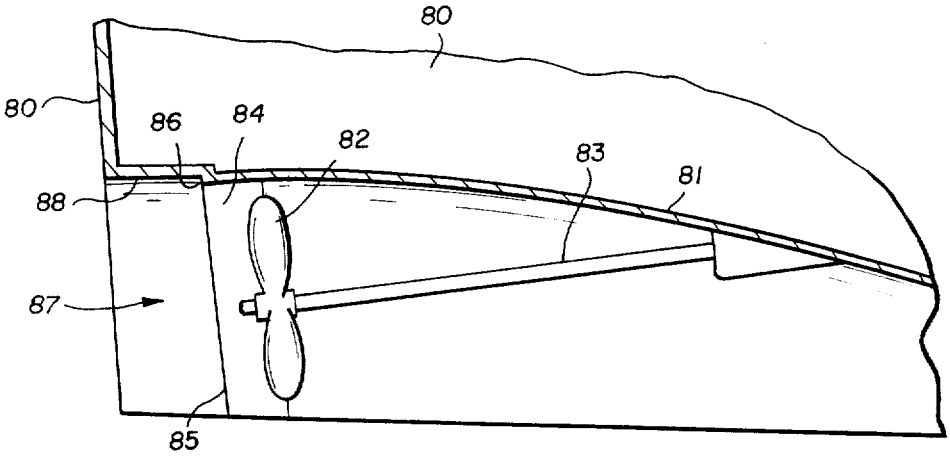
FIG. 20 is a fragmentary, longitudinal cross-sectional view of the boat of FIG. 19.
Figure 21:
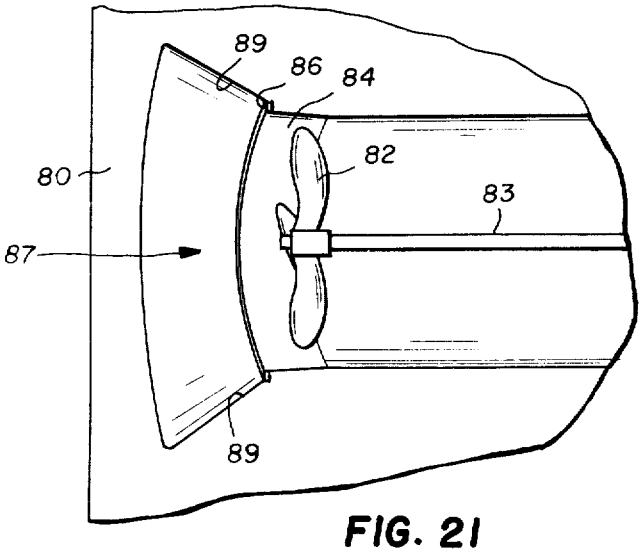
FIG. 21 is a fragmentary bottom view of the boat of FIG. 19.

Boat hull 80 of FIGS. 19–21 has a tunnel 81, the forward region of which is similar to the tunnels described above. A propeller 82 turned by shaft 83 is housed in tunnel 81 as illustrated, and the aft-of-propeller region 84 extends aft as previously described by 25% to 40% of the radius of propeller 82. Aft-of-propeller region 84 terminates at a plane 85 best shown in FIG. 20 as perpendicular to the axis of rotation of propeller 82 and perpendicular to shaft 83. This is important so that the after edge of the aft-of-propeller region 84 terminating at plane 85 is equi-distant from the trailing edges of the blades of propeller 82 throughout the rotational extent of propeller 82.

Tunnel 81 is enlarged radially outward at plane 85 around substantially the entire perimeter of tunnel 81 to provide a radially outward extending surface 86 as best shown in FIG. 19. Outward extending surface 86 gives an expansion and provides open space for the ballooning stream of water flowing aft from region 84, and tunnel 81 preferably extends radially outward by 1 to 2 centimeters at plane 85.

A tunnel discharge region 87 extends aft from the outward opening at plane 85, and discharge region 87 preferably extends approximately horizontally at tunnel top 88 and flares laterally outward at sidewalls 89 as previously described. Discharge region 87 can also have other shapes as previously described, and discharge region 87 preferably provides a substantially increasing area for the expansion of the water stream thrust aft from propeller 82.

The improvement described above at the outward opening 86 at plane 85 perpendicular to the axis of rotation of propeller 82 at the after edge of region 84 has resulted in increased efficiency of up to 10% at the cruising range, compared with the tunnel structures described in the parent application, and boats built according to FIGS. 19–21 also run substantially quieter than their predecessors. The improvement of FIGS. 19–21 can also be applied to twin tunnel versions using the other features described in FIGS. 13–18.

Persons wishing to practice the invention should remember that other embodiments and variations can be adapted to particular circumstances. Even though one point of view is necessarily chosen in describing and defining the invention, this should not inhibit broader or related embodiments going beyond the semantic orientation of this application but falling within the spirit of the invention. For example, those skilled in the art will appreciate the variations that can be made in adapting the invention to specific boats.

I claim:

1. A boat having a deep-V planing hull with port and starboard sides of the hull bottom inclined upward from the keel line and having a propeller substantially housed in a stern tunnel recessed into said hull bottom to a depth progressively increasing with distance aft from the forward end of said tunnel, said boat comprising:

a. the tops of port and starboard halves of a forward region of said tunnel being generally flat and obtusely angled relative to each other at approximately the angle of said deep-V to meet at said deep-V angle above said keel line;

b. said tops of each of said halves of said forward region of said tunnel each having a constant width of slightly more than the radius of said propeller from the forward end of said tunnel to the region of said propeller so that both the cross-sectional area of said tunnel and the wetted surface area of said tunnel substantially increase gradually with distance aft from said forward end of said tunnel;

c. said tops of said halves of said forward region of said tunnel being inclined upward relative to said sides of said hull bottom with increasing distance aft from said forward end of said tunnel; and d. said tops of said tunnel halves in a region just forward of said propeller being gradually shaped into a semi-cylinder fitting around the upper half of said propeller.

2. The boat of claim 1 wherein an aft-of-propeller region of said tunnel has substantially the shape of the portion of said tunnel fitting around said propeller, and said aft-of-propeller region extends aft of the trailing edge of the blades of said propeller by up to 40% of the radius of said propeller.

3. The boat of claim 2 wherein the after edge of said aft-of-propeller region terminates in a plane perpendicular to the rotational axis of said propeller so said after edge is equi-distant from the trailing edges of blades of said propeller throughout the rotation of said propeller, and said tunnel opens radially outward around the entire perimeter of said tunnel at said after edge.

4. In a deep-V tunnel stern boat having a tunnel substantially housing a propeller and forming a semi-cylinder around the upper half of said propeller, an improved shape for said tunnel comprising:

a. a first region of said tunnel having substantially the shape of the portion of said tunnel fitting around said propeller, said first region extending aft of the trailing edge of the blades of said propeller for up to 40% of the radius of said propeller;

b. the after edge of said first region terminating in a plane perpendicular to the rotational axis of said propeller so said after edge is equi-distant from the trailing edges of blades of said propeller throughout the rotation of said propeller;

c. said tunnel opening radially outward around the entire perimeter of said tunnel at said after edge of said first region forming a radially outwardly extending surface;

d. said tunnel having a discharge region extending aft from said radially outwardly extending surface to the transom of said boat at the after end of said tunnel;

e. the side walls of said discharge region extending horizontally substantially outward from said radially outwardly extending surface to said after end of said tunnel; and f. the cross-sectional area of said first region of said tunnel slightly enlarges as said first region extends aft.

5. The boat of claim 4 wherein a forward region of said tunnel forward of said propeller is shaped to provide a resurgent flow uniformly distributed across the width of said tunnel.

6. A boat having a deep-V hull with port and starboard sides of the hull bottom inclined upward from the keel and having a pair of propellers substantially housed respectively in a pair of stern tunnels on opposite sides of said keel, said boat comprising:

a. the tops of forward regions of each of said tunnels being generally flat and divided into inboard and outboard halves respectively recessed into the sides of said hull bottom to a depth progressively increasing with distance aft from the forward ends of said tunnels;

b. said inboard halves of said tunnel tops extending farther forward than said outboard halves of said tunnel tops;

c. said tops of said outboard halves of said forward regions of said tunnels being approximately parallel with said sides of said hull bottom in which said tunnels are respectively recessed;

d. said tops of said inboard halves of said forward regions of said tunnels being approximately parallel with said sides of said hull bottom respectively opposite to said sides of said hull bottom in which said tunnels are respectively recessed;

e. said inboard and outboard halves of said forward regions of said tunnels each having a constant width of slightly more than the radius of said propellers from the forward end of each of said tunnel halves to the region of said propellers so that both the cross-sectional area of said tunnels and the wetted surface areas of said tunnels substantially increase gradually with distance aft from the forward ends of said tunnels; and f. said tops of said tunnel halves in regions just forward of said propellers being gradually shaped into semi-cylinders around the upper halves of said propellers.

7. The boat of claim 6 wherein aft-of-propeller regions of said tunnels have substantially the shape of the portions of said tunnels fitting around said propellers, and said aft-of-propeller regions extend aft of the trailing edges of the blades of said propellers by 25% to 40% of the radius of said propellers.

8. The boat of claim 7 wherein the after edges of said aft-of-propeller regions terminate in a plane perpendicular to the rotational axes of said propellers, and said tunnels open radially outward around substantially the entire perimeter of said tunnels at said after edges.

9. The boat of claim 8 including discharge regions extending aft from said outward openings and a rudder extending from said outward openings aft in each of said discharge regions of said tunnels.

10. A boat having a deep-V hull with port and starboard sides of the hull bottom inclined upward from the keel and having a pair of propellers substantially housed respectively in a pair of stern tunnels on opposite sides of said keel, said boat comprising:

a. forward regions of said tunnels being recessed respectively into said port and starboard sides of said hull bottom to a depth progressively increasing with distance aft from the forward ends of said tunnels;

b. the tops of each of said forward regions of said tunnels being generally flat and approximately parallel with said respective sides of said hull bottom at the angle of said deep-V;

c. each of said forward regions of said tunnels having a constant width of slightly more than the diameter of said propeller from the forward ends of said tunnels to the regions of said propellers so that both the cross-sectional areas of said tunnels and the wetted surface areas of said tunnels substantially increase gradually with distance aft from the forward end of said tunnel;

d. said tops of said tunnels in regions just forward of said propellers being gradually shaped into semi-cylinders around the upper halves of said propellers;

e. aft-of-propeller regions of said tunnels having substantially the shape of the portions of said tunnels fitting around said propellers, and said aft-of-propeller regions extending aft of the trailing edges of the blades of said propellers by up to 40% of the radius of said propellers; and f. the after edges of said aft-of-propeller regions terminate in planes respectively perpendicular to the rotational axes of said propellers so said after edges are equi-distant from the trailing edges of blades of said propellers throughout the rotation of said propellers, and said tunnels open radially ouward around substantially the entire perimeter of said tunnels at said after edges forming radially outwardly extending surfaces.

11. The boat of claim 10 including discharge regions extending aft from said radially outwardly extending surfaces, and a rudder extending from said radially outwardly extending surfaces aft in said discharge regions of said tunnels.

* * * * *